US011759962B2

(12) United States Patent
Rohrbach et al.

(10) Patent No.: US 11,759,962 B2
(45) Date of Patent: Sep. 19, 2023

(54) UTILITY KNIFE

(71) Applicants: Martin Rohrbach, Geoggingen-Horn (DE); Kerry Henn, Solingen (DE)

(72) Inventors: Martin Rohrbach, Geoggingen-Horn (DE); Kerry Henn, Solingen (DE)

(73) Assignee: MARTOR KG, Solingen (DE)

( * ) Notice: Subject to any disclaimer, the term of this patent is extended or adjusted under 35 U.S.C. 154(b) by 0 days.

(21) Appl. No.: 16/796,024

(22) Filed: Feb. 20, 2020

(65) Prior Publication Data

US 2020/0338767 A1 Oct. 29, 2020

(30) Foreign Application Priority Data

Feb. 23, 2019 (DE) ..... 102019001280.1

(51) Int. Cl.
*B26B 5/00* (2006.01)
*B26B 29/02* (2006.01)

(52) U.S. Cl.
CPC ..... *B26B 5/003* (2013.01); *B26B 29/02* (2013.01)

(58) Field of Classification Search
None
See application file for complete search history.

(56) References Cited

U.S. PATENT DOCUMENTS 4,683,656 A * 8/1987 Peyrot ..... B26B 5/003 30/151
4,713,885 A 12/1987 Keklak et al.
4,757,612 A * 7/1988 Peyrot ..... B26B 29/02 30/151
7,322,110 B2 1/2008 Hernandez
8,353,109 B2 1/2013 Rohrbach
9,370,869 B2 * 6/2016 Hongquan ..... B26B 1/08
10,112,312 B2 10/2018 Schekalla
11,084,178 B2 * 8/2021 Huang ..... B26B 5/001
2002/0124418 A1 * 9/2002 Votolato ..... B26B 5/00 30/294
2004/0237312 A1 * 12/2004 Hernandez ..... B26B 5/001 30/162
2005/0055833 A1 * 3/2005 Scarla ..... B26B 1/046 30/156
2011/0167647 A1 7/2011 Gringer et al.
(Continued)

FOREIGN PATENT DOCUMENTS

DE 3121400 A 12/1982
DE 8224475 U 12/1982
(Continued)

*Primary Examiner* — Hwei-Siu C Payer
(74) *Attorney, Agent, or Firm* — Andrew Wilford

(57) ABSTRACT

A utility knife has a housing in which a particle flow cross section is substantially constant or increases in a flow direction of particles from an inlet of the housing into an interior of the housing at an end of the housing to an outlet of the housing. A blade assembly has a blade with a cutting edge and is movable relative to the housing between a stowed position and an operating position for a cutting operation. A first actuating part and a second actuating part mounted movable relative to the first actuating part move of the blade assembly between the stowed and operating positions. First and second slotted links form a four-point linkage with the first and second actuating parts.

13 Claims, 8 Drawing Sheets

(56) References Cited

U.S. PATENT DOCUMENTS

| | | | | |
|---|---|---|---|---|
| 2012/0311870 | A1* | 12/2012 | De | B26B 5/001 30/162 |
| 2013/0067751 | A1* | 3/2013 | Davis | B26B 5/003 30/162 |
| 2016/0158945 | A1 | 6/2016 | Herlitz | |
| 2016/0229074 | A1 | 8/2016 | Rohrbach | |
| 2018/0311839 | A1* | 11/2018 | Huang | B26B 5/001 |
| 2020/0023528 | A1* | 1/2020 | Rohrbach | B26B 5/001 |
| 2020/0338767 | A1* | 10/2020 | Rohrbach | B26B 5/003 |

FOREIGN PATENT DOCUMENTS

| | | | |
|---|---|---|---|
| DE | 20 2015 102 604 | U1 * | 7/2015 |
| EP | 2193891 | A1 | 6/2010 |
| EP | 3 698 929 | A1 * | 2/2020 |
| GB | 2206832 | A | 1/1989 |

* cited by examiner

Fig. 22
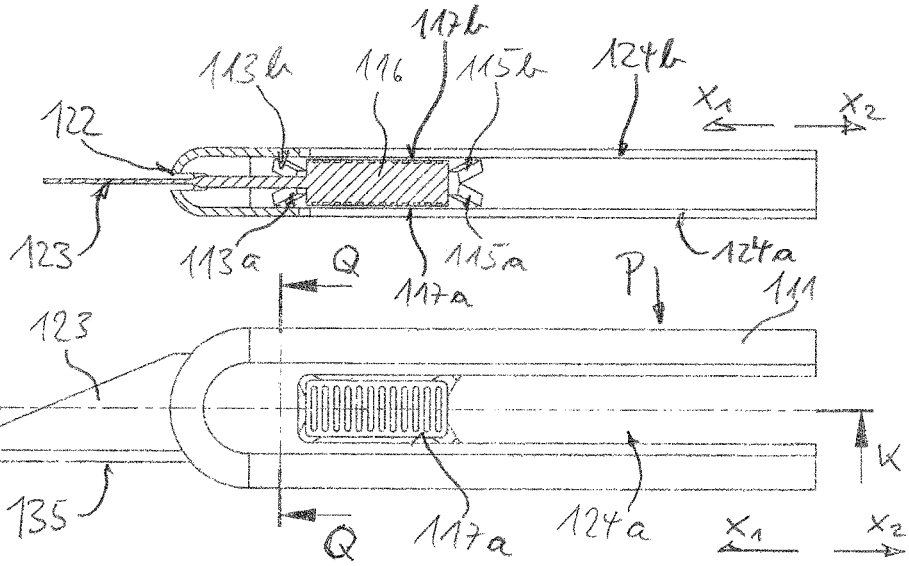
Fig 21
Fig. 23
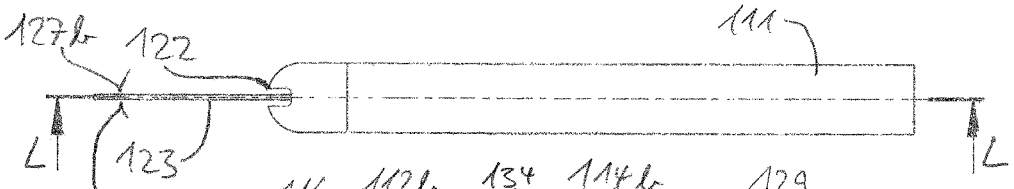
Fig. 24
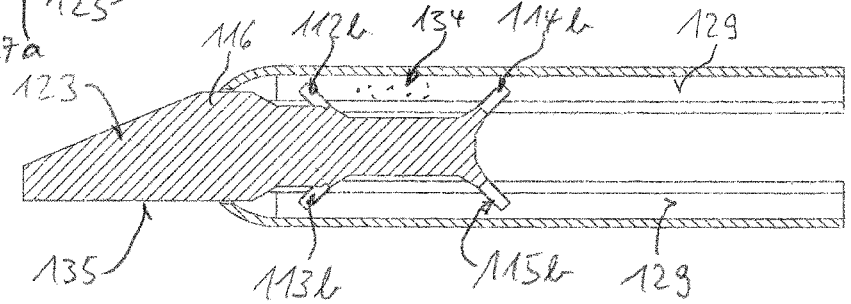
Fig. 25
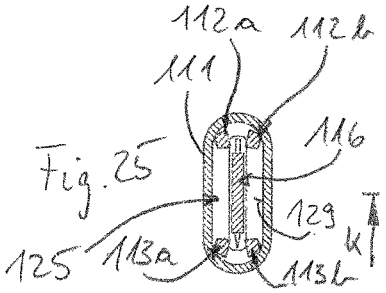

UTILITY KNIFE

FIELD OF THE INVENTION

The invention relates to a utility knife.

BACKGROUND OF THE INVENTION

Such a utility knife is known from EP 2 207 649 [U.S. Pat. No. 8,353,109]. The knife comprises a housing and an actuator that can move a blade support between a safety position in which a blade retained in the blade support is positioned relative to the housing such that the user cannot be injured and a cutting position in which the blade projects from the housing.

It has been found that the functional safety of knives from the prior art that come into contact with slightly sticky or adherent materials, such as powders, during the cutting process is reduced right down to being completely unusable. Particles penetrate into an interior of the housing, and the adhesion of particles can block movement path of movable parts of the utility knife.

OBJECT OF THE INVENTION

The object of the invention is to provide a utility knife designed such that particles that penetrate into the housing can leave the housing again.

SUMMARY OF THE INVENTION

The utility knife comprises a housing having a blade assembly. The blade assembly has at least one blade that is provided with a cutting edge. For example, the blade assembly has a blade holder holding a blade that has a cutting edge. The blade assembly or a blade guard is mounted so as to be movable relative to the housing between a stowed position and at least one operating position. The housing has at least one opening.

A particle flow cross section of the housing remains substantially constant or increases in the flow direction of the particles from an inlet opening for the particles at a front end of the housing to an outlet opening for the particles at a rear end or on a lower face of the housing.

The blade assembly is e.g. mounted on the housing only by pivot joints and/or sliding surfaces and the cooperating sliding surfaces of the housing and the blade assembly form point contact. For example, the housing or the blade assembly has projections that form point contact with a counter surface of the other part.

In tests, it has been found that, in this way, the accumulation of particles in the housing can be considerably reduced and high functional safety can be achieved even when the material to be cut is problematic, such as sacks containing hydrophilic powders that tend to adhere.

One embodiment is characterized in that the spacing between opposing inner wall faces of the housing forming the flow cross section is substantially constant or increases. For example, opposing side faces of the housing-like first actuating part are at a constant or increasing spacing.

One embodiment is characterized in that the inner housing wall has planar faces or faces that are circularly arcuate. This prevents particles from adhering to the inner housing wall, since angles or interstices promote the adhesion of particles.

In principle, it is possible for the first actuating part to be pivotable or movable relative to the second actuating part.

The utility knife has e.g. a first actuating part and a second actuating part that is mounted so as to be movable relative to the first actuating part, the blade assembly or blade guard being actuated by movement of the first actuating part relative to the second actuating part. Pivotally mounting the first actuating part relative to the second actuating part has advantages over movable mounting since the construction can be designed to have fewer contacting sliding surfaces.

In the operating position, e.g. the second actuating part is spaced apart from the first actuating part over a substantial part of the longitudinal extension of the outlet opening such that the opening is not closed by the second actuating part, i.e. does not prevent particles leaving.

One embodiment is characterized in that the blade assembly forms a coupling together with a first connecting rod and a second connecting rod and with the first actuating part and/or the second actuating part. With a coupling, it is possible to mount the blade support only by pivot joints, such that large sliding surfaces that have lower functional reliability when particles accumulate, are largely avoided.

For example, the blade unit or blade guard forms a four-pivot system together with a first connecting rod and a second connecting rod and with the first actuating part and/or the second actuating part.

In the stowed position, the blade is e.g. moved into the interior of a housing formed by the first actuating part and/or the second actuating part such that a user cannot come into contact with the cutting edge and, in the operating position, the blade projects from the opening in the housing. Within the meaning of the invention, "housing" is understood such that it does not necessarily have to be an all-around enclosure, but instead may for example be a (mesh?)grating that prevents contact with the cutting edge of the blade.

Alternatively, in the stowed position, the blade guard is moved over the blade such that a user cannot come into contact with the cutting edge and, in the operating position, the cutting edge is freely accessible.

One embodiment of the invention is characterized in that the housing has a front end, a rear end, opposing sides, an upper face and a lower face, and in that an opening through which particles can leave the housing is formed at least on the lower face.

One embodiment is characterized in that the outlet through which particles leave the housing extends at least over a longitudinal housing region in which movable actuating parts that actuate the blade unit are provided.

The outlet opening through which particles leave the housing extends e.g. at least over a longitudinal housing region that includes movement range of movable actuating parts between the first and the second actuating parts that support the blade assembly. If particles go beyond contact with the blade assembly and come into contact with movable actuating parts, they can easily leave the interior of the housing-like first actuating part. For example, the opening extends from a pivot joint between the first actuating part and the second actuating part as far as a rear end of the knife. In this case, the majority of the particles have already left the interior before coming into contact with the parts supporting the blade assembly.

One embodiment is characterized in that the outlet extends from a pivot joint formed by the first actuating part and the second actuating part as far as a rear end of the knife.

The knife comprises a housing having a blade assembly. The blade assembly has at least one blade that is provided with a cutting edge. For example, the blade assembly has a blade holder having a blade retained therein. The blade assembly or a blade guard is mounted so as to be movable relative to the housing between a stowed position and at least one operating position. The housing has at least one opening.

The opening through which particles leave the housing extends e.g. at least over a longitudinal housing region that includes movement range of movable actuating parts that support the blade assembly. If particles go beyond contact with the blade assembly and come into contact with movable actuating parts, they can easily leave the interior of the housing-like first actuating part.

For example, the opening extends from a pivot joint between the first actuating part and the second actuating part as far as a rear end of the knife. In this case, the majority of the particles have already left the interior before coming into contact with the parts supporting the blade assembly.

For example, the opening extends over a length of at least a third, in particular half or in particular two thirds of the total length of the housing, based on a central longitudinal axis of the housing.

One embodiment of the invention is described by way of example in the following description of the figures, also with reference to the schematic drawings. Here, for the sake of clarity, even if different embodiments are involved, identical or comparable parts or elements have been denoted by identical reference signs, sometimes with the addition of lower case letters.

Features that are only described, set out or disclosed in relation to one embodiment can also be provided in any other embodiment of the invention within the scope of the invention.

Even if they are not shown in the drawings, such amended embodiments are covered by the invention.

All the features disclosed are essential to the invention per se. The content of the disclosure of the cited documents, i.e. the documents under attorney references 27712-02 and 27713-02, and the prior art devices described are hereby incorporated into the disclosure of the application in their entirety, also for the purpose of incorporating individual features or a plurality of features of the subjects disclosed therein into one or more claims of the present application. Even if they are not shown in the drawings, such amended embodiments are also covered by the invention.

BRIEF DESCRIPTION OF THE DRAWING

In the drawings:

FIG. 21 shows the knife based on FIG. 17, with the blade assembly being in the cutting position, FIG. 22 is a section along section line K-K in FIG. 21, FIG. 23 is a view from the direction of the arrow P in FIG. 21, FIG. 24 is a section along section line L-L in FIG. 23, FIG. 25 is a section along section line Q-Q in FIG. 21.

SPECIFIC DESCRIPTION OF THE INVENTION

Figure 1:
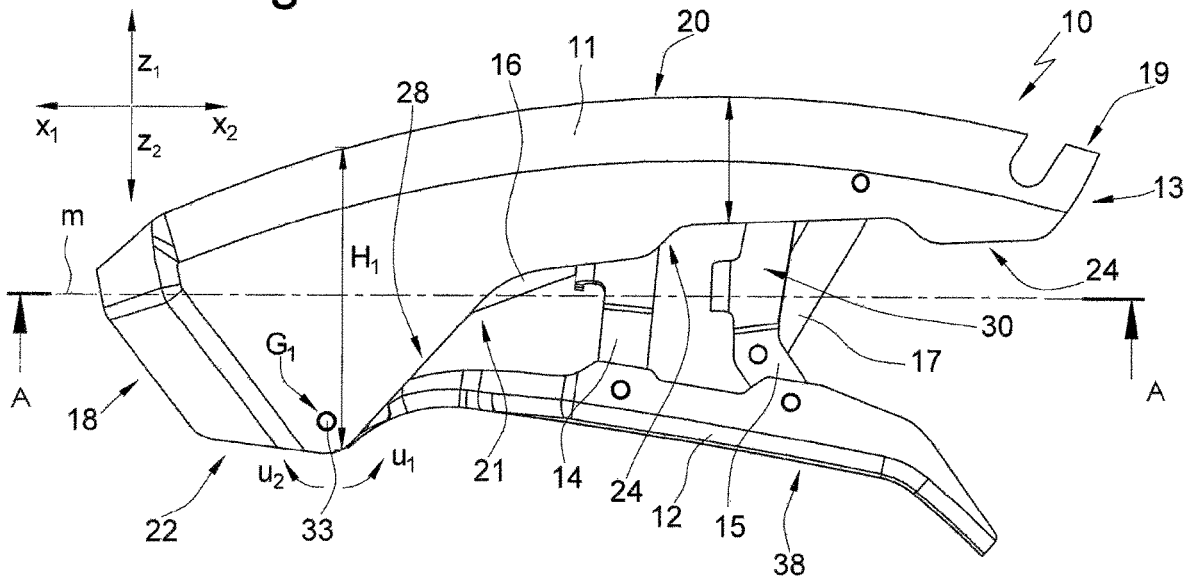
FIG. 1 is a side view of the utility knife in the stowed position.

The utility knife as a whole is denoted by reference sign 10 in the drawings.

The direction $x_1$ points forward, based on a longitudinal axis m of the utility knife 10, the direction $x_2$ points backward, the direction $z_1$ points upward and the direction $z_2$ points downward. The direction $y_1$ points to the left along a longitudinal axis m of the knife 10, and the direction $y_2$ points to the right.

The knife 10 has a housing-like first actuating part 11 and a second actuating part 12. The first actuating part 11 and the second actuating part 12 form a pivot joint $G_1$, such that the knife 10 can be moved out of the stowed position shown in FIG. 1 into an operating position shown in FIG. 3*a* when the second actuating part 12 is pivoted in the direction $u_1$ relative to the first actuating part 11.

The actuating parts 11 and 12 form a mechanism 13 that further has a slotted link 14 and a slotted link 15 that each form a pivot joint together with the second actuating part 12 and also each form a pivot joint together with a blade assembly 16. The slotted links 14 and 15, the second actuating part 12 and the blade assembly 16 form a coupling 30 in this way. A support 17 forms a pivot joint together with the slotted link 15 and forms a pivot joint together with the first actuating part 11.

When the mechanism 13 moves from the stowed position into the operating position, a spring is tensioned and urges the mechanism 13 into the stowed position. If the user relieves the load on the first actuating part 11 and the second actuating part 12, the mechanism 13 therefore automatically returns to the stowed position according to FIG. 1. In the process, the second actuating part 12 is also pivoted in the direction $u_2$ relative to the first actuating part 11.

The first actuating part 11 has a front end 18, a rear end 19, an upper face 20 and a lower face 21. The front end 18 is provided with an opening 22, through which a blade 23 having a cutting edge 35 can project from the housing-like first actuating part 11. Furthermore, the lower face 21 is provided with an opening 24 that extends approximately from the pivot joint $G_1$ as far as the rear end 19. In the present embodiment, the openings 22 and 24 are separated only by a shaft element 33 that is part of the pivot joint $G_1$.

The first actuating part 11 is U-shaped in cross section, an interior 25 of the first actuating part 11 being produced between the side walls 26*a* and 26*b*. In a front region of the knife 10 in which the blade 23 is in the stowed position, the side walls 26*a* and 26*b* are provided with a greater height H1 than in a rear region of the first actuating part 11, in which it has a height.

During movement between the stowed position and the operating position, an actuation force is transferred to the slotted link 15 via the support 17, such that, in the operating position, the coupling 30 assumes a position in which a blade 23 projects through the opening 22 out of the interior 25 of the first actuating part 11 at least in part.

During cutting processes, particles 34 that could impair the function of the knife 10 if they accumulate in larger quantities in the interior 25 substantially enter the interior 25 through the opening 22, e.g. because particles 34 adhere to side faces 27*a* and 27*b* of the blade 23 and are carried into the interior 25 when the knife 10 moves into the stowed position. In the drawings, the particles 34 entering the interior 25 are schematically shown by the arrows 36 and the particles 34 leaving the interior 25 are schematically shown by the arrows 37.

Figure 2:
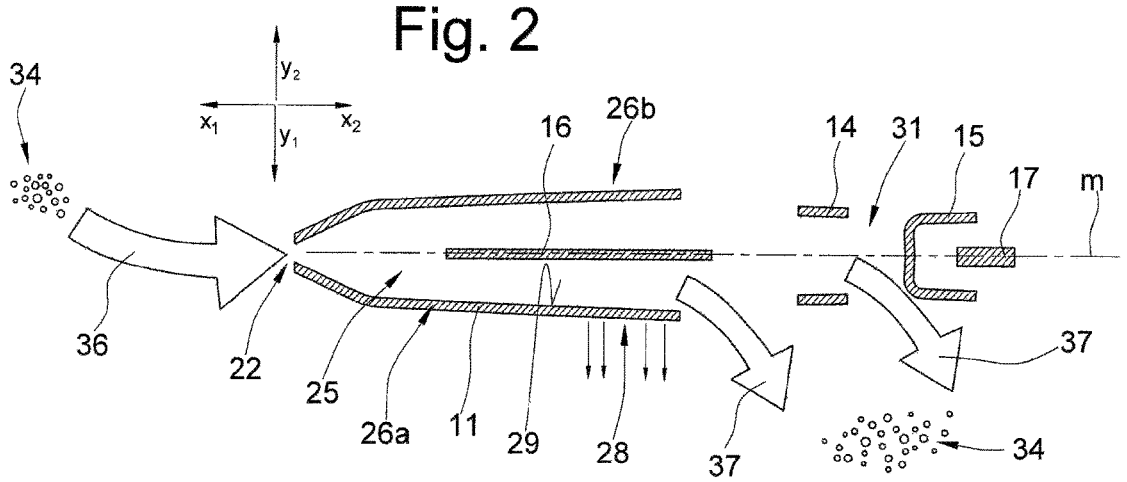
FIG. 2 is a section along section line A-A in FIG. 1.
Figure 4:
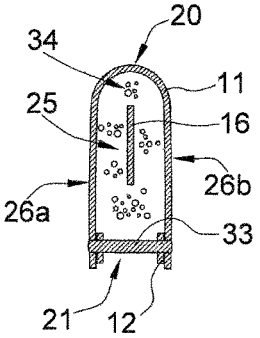
FIG. 4 is a section along section line B-B in FIG. 3*a*.
Figure 5:
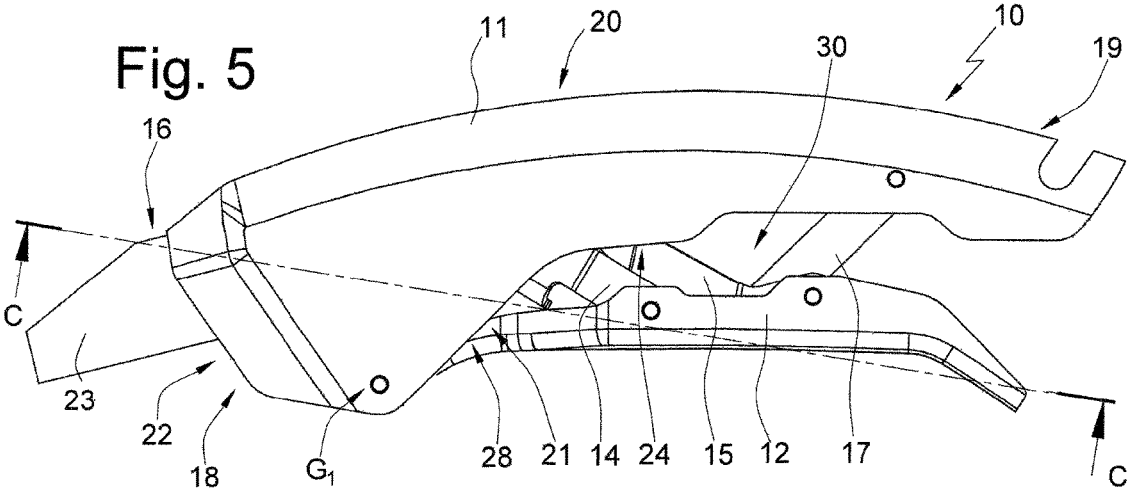
FIG. 5 is a side view of the knife in the operating position according to FIG. 3.
Figure 6:
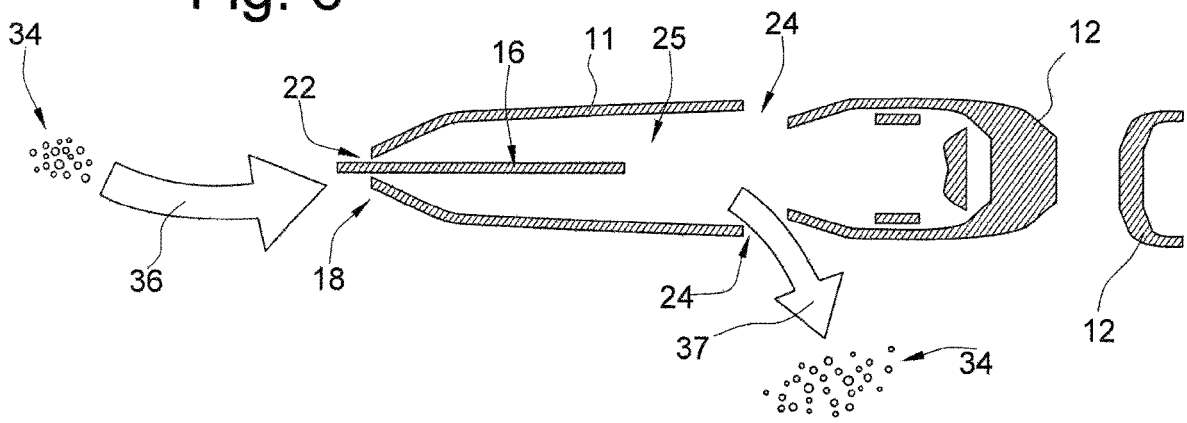
FIG. 6 is a section along section line C-C in FIG. 5.

It can be seen in FIGS. 2 and 4 that, in the front end 18, the side walls 26*a* and 26*b* taper toward the side walls 27*a* and 27*b* of the blade 23. In this way, when the knife 10 is moved from the operating position into the stowed position, particles 34 having large dimensions and particle conglomerates are prevented from entering the interior 25. Particles projecting from the side faces 27*a* and 27*b* are pulled off by the side walls 26*a* and 26*b* that are close to the side walls 27*a* and 27*b*.

Nevertheless, particles 34 cannot be completely prevented from entering the interior 25. Particles that have moved into the interior 25 together with the blade assembly 16 can, according to FIG. 2, escape from the interior 25 again in a region 28 of the opening 24 before they enter movement region of the slotted links 14 and 15. In a region 39 (see FIG. 3*b*) adjacent to the first housing part 11, i.e. adjacent to the pivot joint $G_1$, the second actuating part 12 has a smaller width B2 compared with a free end 38 that is provided with a width B1. For this reason, openings 41*a* and 41*b* that form an outlet 37 for the particles 34, are formed in the region 39 between the second actuating part 12 and the side wall 26*a* as well as between the second actuating part 12 and the side wall 26*b*. In addition, directly in the region of the pivot joint $G_1$, the second actuating part 12 has an opening 40 that likewise forms an outlet 37 for particles 34.

Should the particles 34 move into a rear region 31 of the interior 25 in which the slotted links 14 and 15 as well as the support 17 are provided, they can also leave the interior 25 very easily through the opening 24, since the side walls 26*a* and 26*b* only have the height in this region. This, however, only relates to a very small proportion of the particles 34 that have entered the interior 25, since the majority of the particles 34 have already left the interior 25 in the region 28 of the opening 24.

In order to prevent particles 34 in the interior 25 from adhering to an inner face 29 of the first actuating part 11, the inner face 29 has large radii and avoids any sharp angles and interstices in which particles 34 can become adhered (see e.g. FIGS. 4, 10, 12, 14 and 15). As can be seen in particular in FIG. 10, the inner face 29 only has curved or planar regions.

Figure 3A:
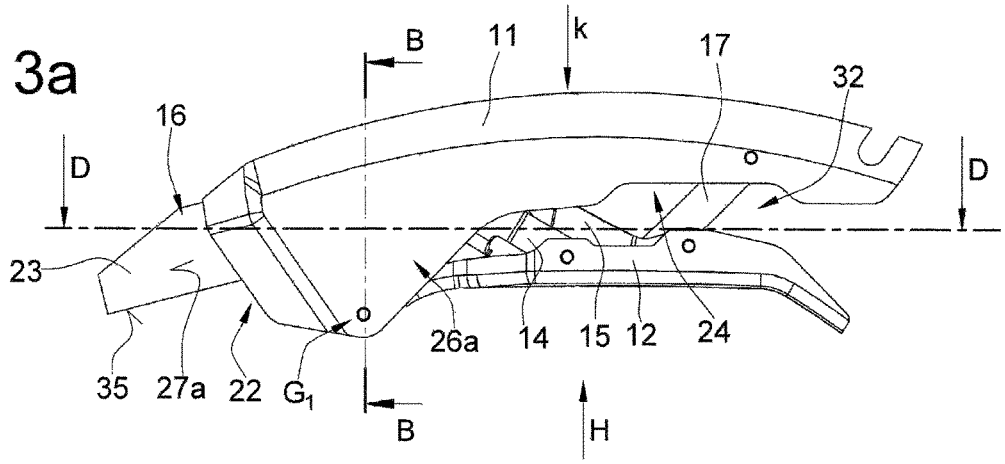
FIG. 3*a* is a side view of the utility knife in the operating position.
Figure 3B:
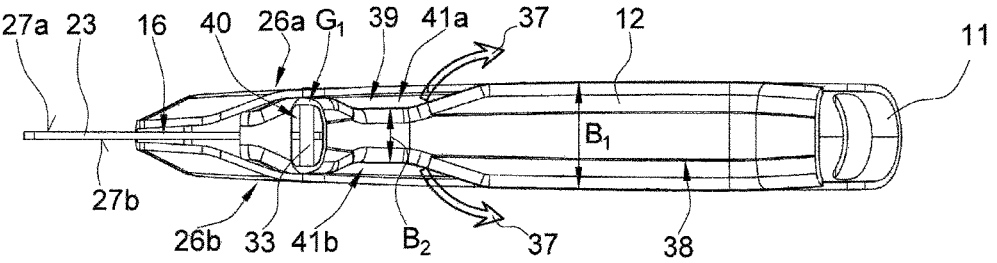
FIG. 3*b* is a view of the utility knife from the direction of the arrow H in FIG. 3*a*.
Figure 3C:
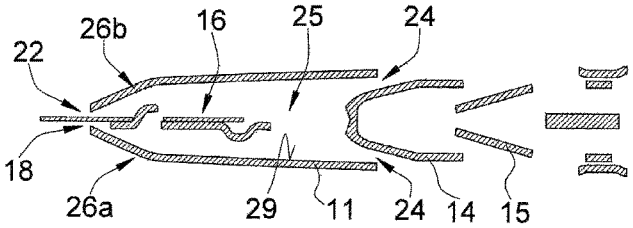
FIG. 3*c* is a section of the knife along section line D-D in FIG. 3*a*.
Figure 7:
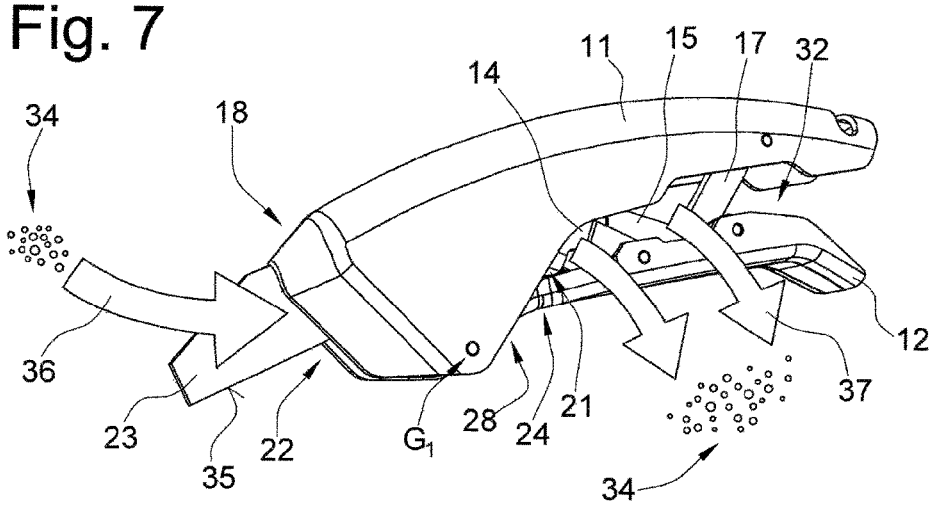
FIG. 7 is an oblique perspective front view of the knife in the operating position.
Figure 8:
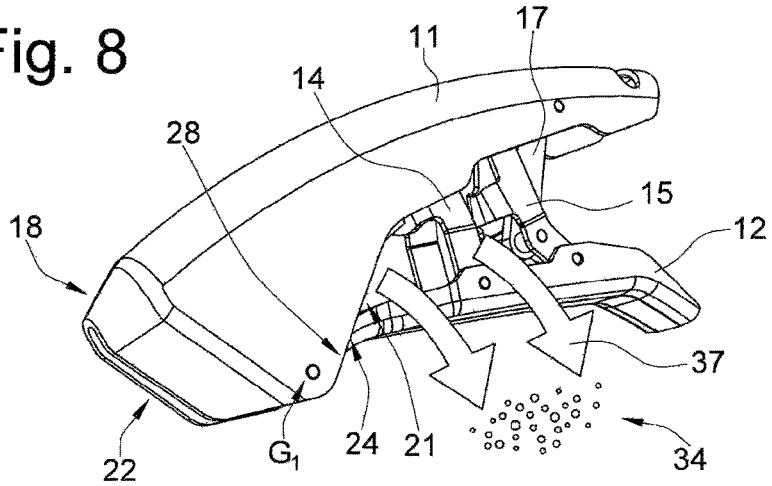
FIG. 8 is an oblique perspective front view of the knife in the stowed position.
Figure 9:
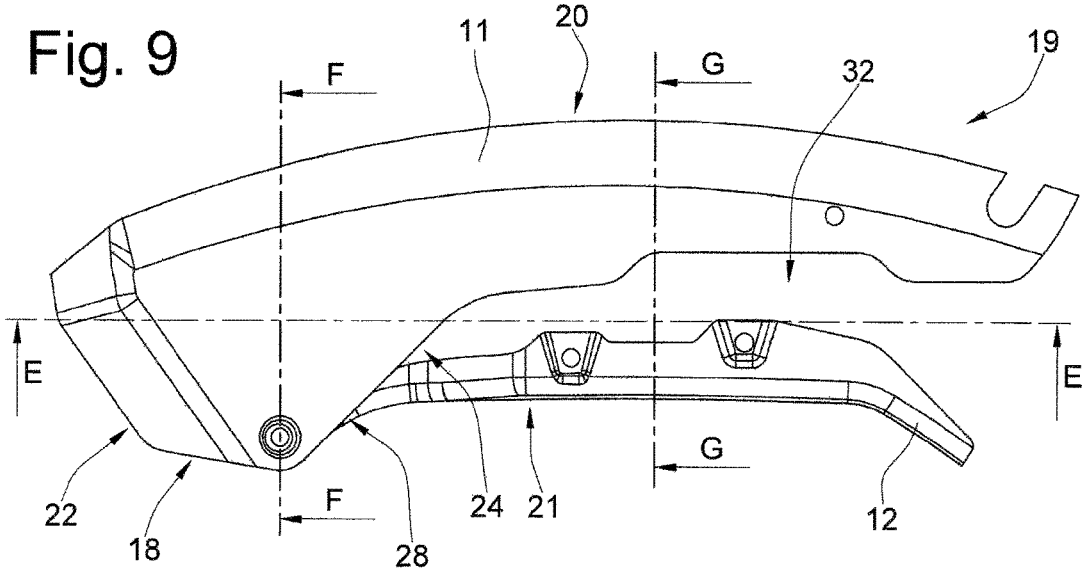
FIG. 9 is a side view of the knife in the operating position, with parts of the mechanism including the blade assembly not being shown for the sake of clarity.
Figure 10:
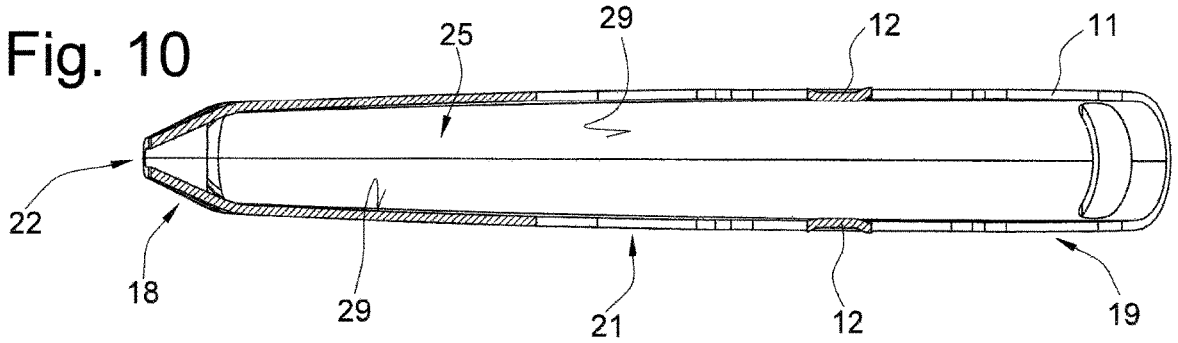
FIG. 10 is a section along section line E-E in FIG. 9.
Figure 11:
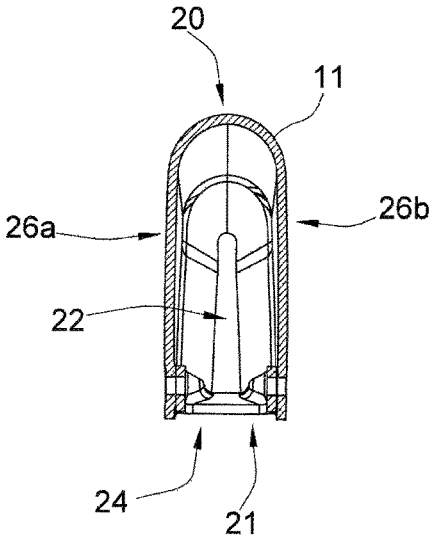
FIG. 11 is a section along section line F-F in FIG. 9.
Figure 12:
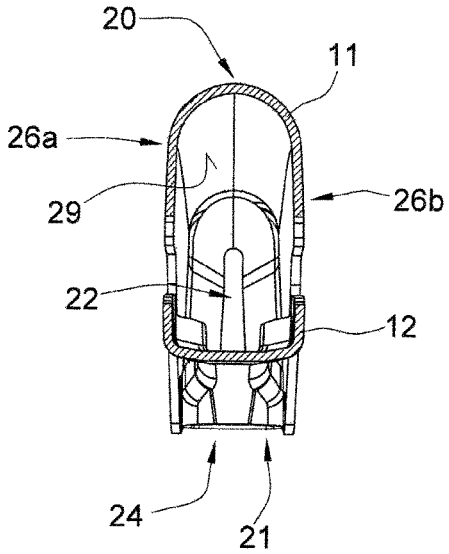
FIG. 12 is a section along section line G-G in FIG. 9.
Figure 13:
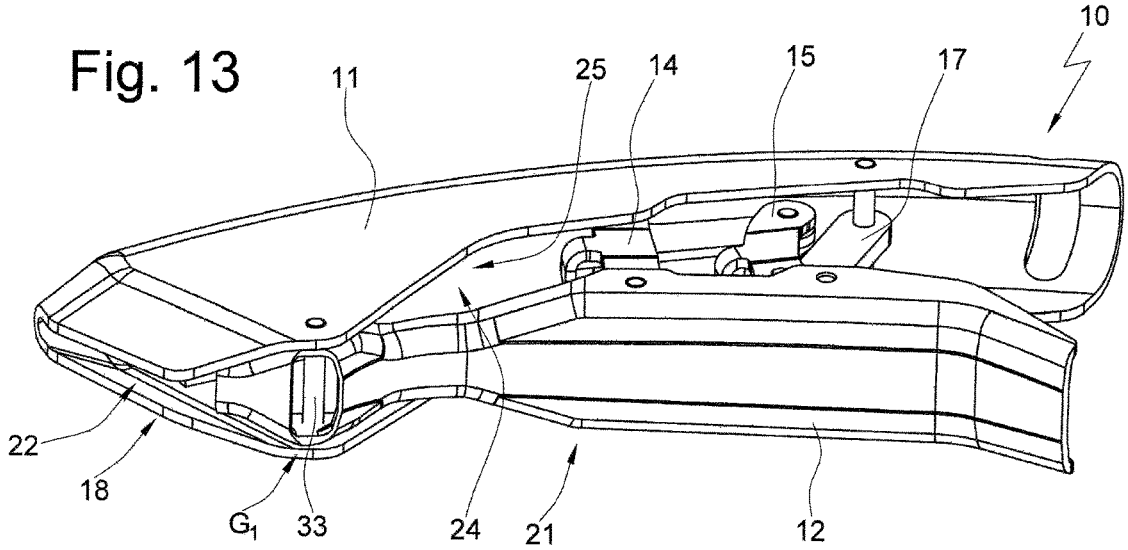
FIG. 13 is a perspective view of the knife.
Figure 14:
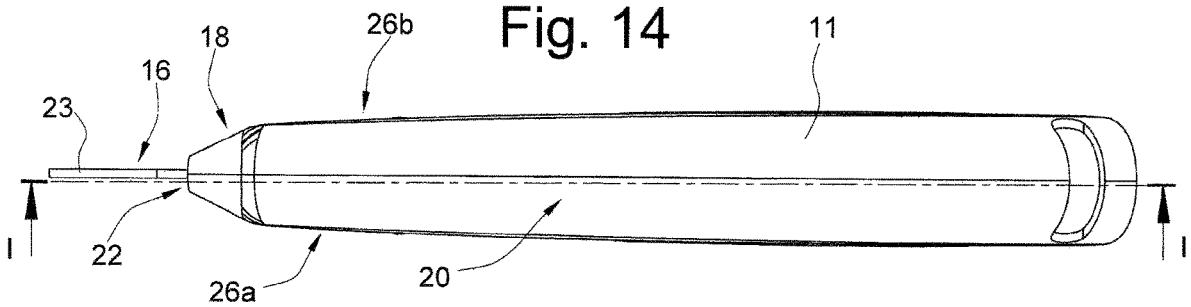
FIG. 14 is a view from the direction of the arrow K in FIG. 3*a*.
Figure 15:
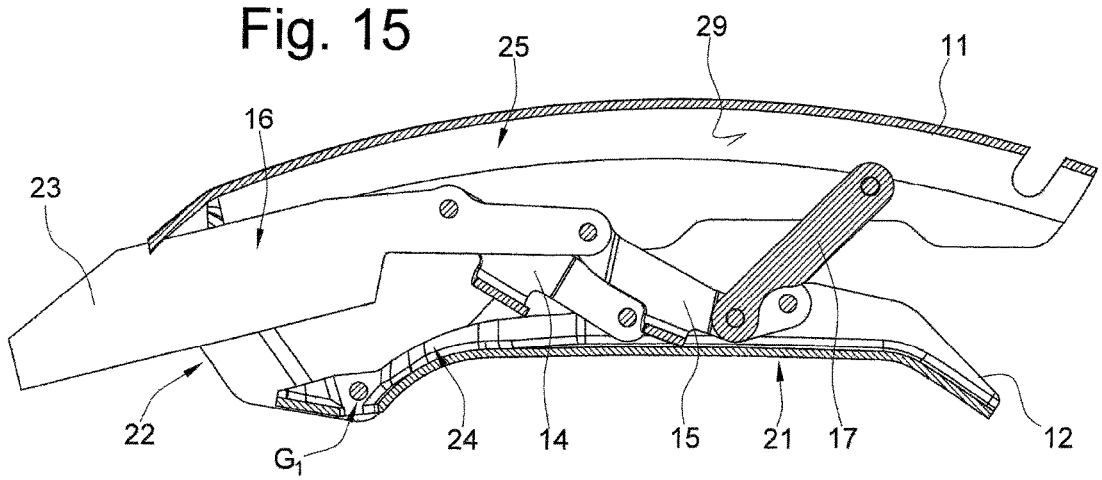
FIG. 15 is a section along section line I-I in FIG. 14.
Figure 16:
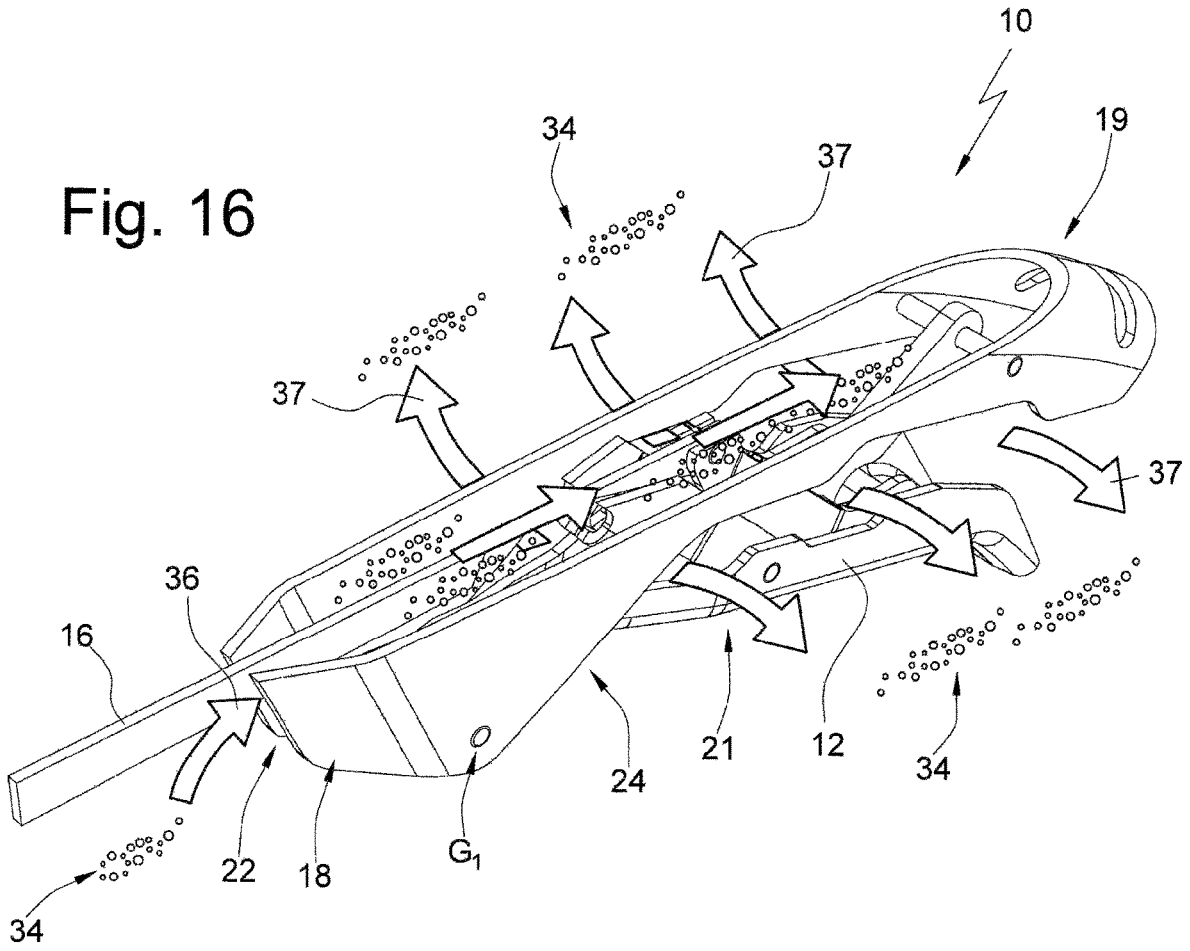
FIG. 16 is an oblique perspective front view of the knife, with an upper region of the knife having been cut away.
Figures 17, 18, 19, 20:
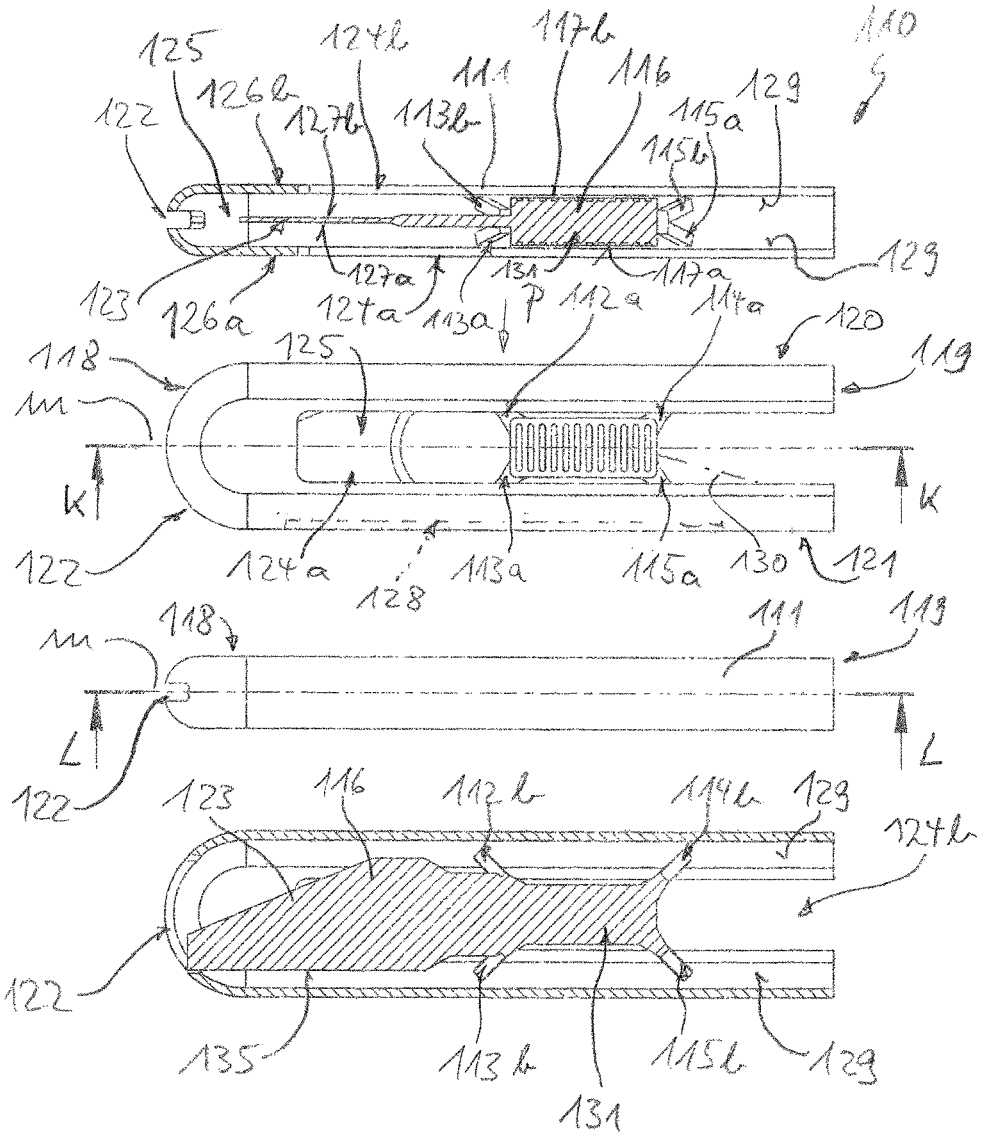
FIG. 17 is a side view of a second embodiment of the knife according to the invention in a safety position of the blade assembly.
FIG. 18 is a section along section line K-K in FIG. 17.
FIG. 19 is a view from the direction of the arrow P in FIG. 17.
FIG. 20 is a section along section line L-L in FIG. 19.

For example, it can be seen in FIGS. 3*a* and 7 that, in the operating position in which the first actuating part 11 is pivoted toward the second actuating part 12 to its maximum in the direction $u_1$, a space 32 is formed between the first actuating part 11 and the second actuating part 12 that allows the particles leaving through the opening 24 to escape past the second actuating part 12 unimpeded.

It becomes clear that the blade assembly 16 is supported on the actuating parts 11 and 12 by pivot joints and, furthermore, does not come into contact with the actuating parts 11 and 12.

A utility knife according to a second embodiment is shown in FIGS. 17 to 25. The knife 110 has a housing 111 that has a front end 118, a rear end 119, an upper face 120 and a lower face 121. Openings 124*a* and 124*b* for actuating a blade assembly 116 and for particles of dirt to leave the housing 111 are formed on two opposing side walls 126*a* and 126*b*. In addition, an opening 128 for dirt to leave may be formed on the lower face 121, for example.

In an interior 125 of the housing 111, the blade assembly 116 is slidable in a straight line between a safety position shown in FIGS. 17 to 20, in which a cutting edge 135 of a blade 123 of the blade assembly 116 is positioned in the housing 111 so as to be inaccessible to the user, and a cutting position shown in FIGS. 21 to 25, in which the cutting edge 135 emerges from an opening 122 in the housing 111 for a cutting process. The blade assembly 116 may, for example, be loaded in the safety position by a spring 130 that is only shown as a dashed line in FIG. 17.

The blade assembly 116 has actuating surfaces 117*a* and 117*b* that can be actuated through the openings 124*a* and 124*b* in order to move the blade assembly 116 between the safety position and the cutting position.

The blade assembly 116 may be formed in one piece or, for example, may comprise a blade support, in which a blade is detachably retained. Whether the blade assembly is formed in one piece or in multiple pieces does not play a significant role in the invention. In the present example, the blade 123 is designed as a region of the blade assembly 116 and is integrally connected to a supporting region 131. It is instead the support mounting of the blade assembly 116 that is essential here.

The blade assembly 116 has arms 112*a* and 112*b*, 113*a* and 113*b*, 114*a* and 114*b* as well as 115*a* and 115*b*. The arms are positioned such that the blade assembly 116 is slidable in a straight line in the directions $x_1$ and $x_2$ between the safety position.

Each arm forms point contact with an inner face 129 of the housing 111. This means that the contact surface is less than 2 $mm^2$, e.g. 0.5 $mm^2$. Owing to the low level of contact, movement of the blade assembly 116 is not vulnerable to particles 134 that are in the interior 125. Owing to the punctiform contact between the arms of the blade assembly 116 and the inner face 129, particles 134 are prevented from accumulating between surfaces of the blade assembly 116 and the inner face 129.

The arms 112*a* and 112*b*, 113*a* and 113*b*, 114*a* and 114*b* as well as 115*a* and 115*b*, can in particular space apart the blade region 123, but also the supporting region 131, from the inner faces 129 of the housing 111 such that particles of dirt do not easily accumulate between the blade assembly 116 and the inner walls and impair movement of the blade assembly 116.

The opening 122 is formed such that it surrounds the blade 123, in particular side faces 127*a* and 127*b* of the blade 123, at a small spacing, movement of the blade between the safety position and the cutting position being ensured. In this way, during a cutting process, the influx of particles 134 into the interior 125 of the housing 111 is kept low.

The invention claimed is:

1. A utility knife comprising a housing formed with an inlet opening and an outlet opening, a blade assembly having a blade with a cutting edge, the housing having a first actuating part and a second actuating part movable relative to the first actuating part for movement of the blade assembly between a stowed position and a cutting position, pivot joints supporting the blade assembly on the housing for movement relative to the housing between the stowed position in which the cutting edge is protected so as to be inaccessible and the cutting position in which the cutting edge is moved relative to the housing for a cutting operation, and a first link and a second link forming with the blade assembly and with the second actuating part a linkage and each of the first link and the second link forming a respective one of the pivot joints together with the second actuating part and with the blade assembly, the housing having a particle flow cross section that is substantially constant or increasing in a flow direction of particles from the inlet opening for the particles into an interior of the housing at an end of the housing to the outlet opening for the particles, the blade assembly being supported on the housing only by the pivot joints.

2. The utility knife according to claim 1, wherein the outlet opening is provided at a rear end and/or on a lower face of the housing.

3. The utility knife according to claim 1, wherein a spacing between opposing inner wall faces of the housing forming the flow cross section is substantially constant or increases toward the outlet opening.

4. The utility knife according to claim 1, wherein an inner wall of the housing has planar or circularly arcuate faces.

5. The utility knife according to claim 1, wherein, in the cutting position, the second actuating part is spaced from the first actuating part over a substantial part of a longitudinal extension of the outlet opening such that the outlet opening is not closed by the second actuating part.

6. The utility knife according to claim 1, wherein in the stowed position, the blade is moved into the housing such that a user cannot come into contact with the cutting edge and in the cutting position the blade projects from the inlet opening of the housing.

7. The utility knife according to claim 1, wherein the housing has a front end, a rear end, opposing sides, an upper face and a lower face, the outlet opening through which particles can leave the housing being formed at least on the lower face.

8. The utility knife according to claim 1, wherein the blade assembly is mounted on the housing only by the pivot joints.

9. A utility knife comprising a housing formed with an inlet opening and an outlet opening;

a blade assembly having a blade with a cutting edge;

pivot joints supporting the blade assembly on the housing for movement relative to the housing between a stowed position in which the cutting edge is a protected so as to be inaccessible and a cutting position in which the cutting edge is moved relative to the housing for a cutting operation, the housing having a particle flow cross section that is substantially constant or increasing in a flow direction of particles from the inlet opening for the particles into an interior of the housing to the outlet opening at an end of the housing;

a first actuating part of the housing;

a second actuating part of the housing movable relative to the first actuating part for movement of the blade assembly between the stowed and cutting positions; and a first link and a second link together forming with the blade assembly and with the second actuating part a four-pivot system comprising the pivot joints.

10. A utility knife comprising a housing formed with an inlet opening and an outlet opening and having a first actuating part and a second actuating part, a blade assembly having a blade with a cutting edge, and pivot joints supporting the blade assembly on the housing for movement relative to the housing between a stowed position in which the cutting edge is positioned in a protected position so as to be inaccessible and a cutting position in which the cutting edge is moved relative to the housing for a cutting operation, the housing having a front end, a rear end, opposing sides, an upper face, and a lower face, the outlet opening through which particles can leave the housing being on the lower face; and a first link and a second link together forming with the blade assembly and with the second actuating part a four-pivot system comprising the pivot joints.

11. The utility knife according to claim 10, wherein the outlet opening is not closed in the stowed position or in the cutting position.

12. The utility knife according to claim 10, wherein the outlet opening extends over a length of at least a third of a total length of the housing measured along a central longitudinal axis of the housing.

13. A utility knife comprising:

a housing in which a particle flow cross section is substantially constant or increasing in a flow direction of particles from an inlet opening of the housing into an interior of the housing at an end of the housing to an outlet opening of the housing, a blade assembly having a blade with a cutting edge and movable relative to the housing between a stowed position in which the cutting edge is positioned in a protected position so as to be inaccessible and a cutting position in which the cutting edge is moved relative to the housing for a cutting operation, a first actuating part of the housing and a second actuating part of the housing mounted movable relative to the first actuating part for movement of the blade assembly between the stowed and cutting positions, and first and second links forming a four-pivot linkage with the second actuating part and with the blade assembly.

* * * * *